US007200960B1

(12) United States Patent
Waggoner et al.

(10) Patent No.: US 7,200,960 B1
(45) Date of Patent: Apr. 10, 2007

(54) FOLDABLE INFORMATION CARD WITH POCKET FOR STORAGE

(75) Inventors: Bryce C. Waggoner, Monroe, OH (US); Kevin R. Keys, Danville, VA (US)

(73) Assignee: The Standard Register Company, Dayton, OH (US)

( * ) Notice: Subject to any disclaimer, the term of this patent is extended or adjusted under 35 U.S.C. 154(b) by 392 days.

(21) Appl. No.: 10/164,211

(22) Filed: Jun. 6, 2002

(51) Int. Cl.
*G09F 1/00* (2006.01)

(52) U.S. Cl. ..... 40/124.09; 40/124.03

(58) Field of Classification Search ..... 40/124.06, 40/124.09, 124.11–124.13, 654.01, 664, 672, 40/673; 150/147, 148, 149, 152
See application file for complete search history.

(56) References Cited

U.S. PATENT DOCUMENTS 515,275 A * 2/1894 Bishoprick ..... 229/74
4,852,783 A * 8/1989 Bryden et al. ..... 224/684
5,487,566 A 1/1996 Hedge, Jr.
5,603,529 A 2/1997 Breindel
5,621,990 A * 4/1997 Blanchard ..... 40/124.06
5,778,574 A * 7/1998 Reuben ..... 40/124.03
5,845,772 A * 12/1998 Cieplak ..... 206/308.3
6,073,967 A 6/2000 Hansen et al.
6,206,428 B1 3/2001 Hansen et al.
6,347,471 B1 * 2/2002 Mirza ..... 40/661

* cited by examiner

*Primary Examiner*—Cassandra Davis
(74) *Attorney, Agent, or Firm*—Dinsmore & Shohl LLP

(57) ABSTRACT

A foldable information card that is useful for storing related documents is provided. Specifically, a foldable card that may contain warranty or product information to be given to a consumer is provided. The foldable card has a storage pocket for related documents such as sales receipts. Additionally, the foldable card has a repositionable adhesive that may be used to secure the card in a folded configuration and prevent documents from falling out of the storage pocket. Information may be printed on the foldable card in more than one language.

23 Claims, 5 Drawing Sheets

FOLDABLE INFORMATION CARD WITH POCKET FOR STORAGE

BACKGROUND OF THE INVENTION

The present invention relates to a printable fold up card that includes a storage arrangement. Specifically, the present invention relates to a card having product or warranty information and a pocket for storing related documents.

It is common in many industries to supply warranty or product information to customers along with other information such as the model number, serial number, sales slip, and the salesman's business card when a product is sold. Typically, this information is provided to the customer on several sheets of paper, and these sheets are easy to misplace. Consumers are often required to retain proof of purchase or other information to obtain service under a warranty.

Thus, there is a need for an information card that has storage for documents related to the particular product. Additionally, there is a need for an information card that provides a means for securing loose documents to the information card.

SUMMARY OF THE INVENTION

The present invention overcomes the disadvantages of the prior art by providing a foldable card having a pocket for the storage and retention of related documents. By providing a foldable card with a pocket, product information or warranty information may be kept with other documents such as the sales receipt in the customer's records. The foldable card also may have a repositionable adhesive that allows the foldable card to be secured in a folded configuration and subsequently reopened to access any pertinent information. The foldable card may be provided with shaped perforations that allow a fastener to be passed through the foldable card so that the card may be attached to a product to which it pertains.

Accordingly, it is an object of the present invention to provide an information card that may be used to store related documents.

Further, it is an object the present invention to provide an information card that may be used to ensure that related documents are not lost but that allows the related documents to be accessed by a consumer as needed.

Further, it is an object of the present invention to provide an information card that may have warranty information printed thereon in more than one language.

Additional objects and advantages of the present invention will become apparent from the subsequent drawings and detailed description of the preferred embodiments.

DETAILED DESCRIPTION OF THE PREFERRED EMBODIMENTS

Figure 1:
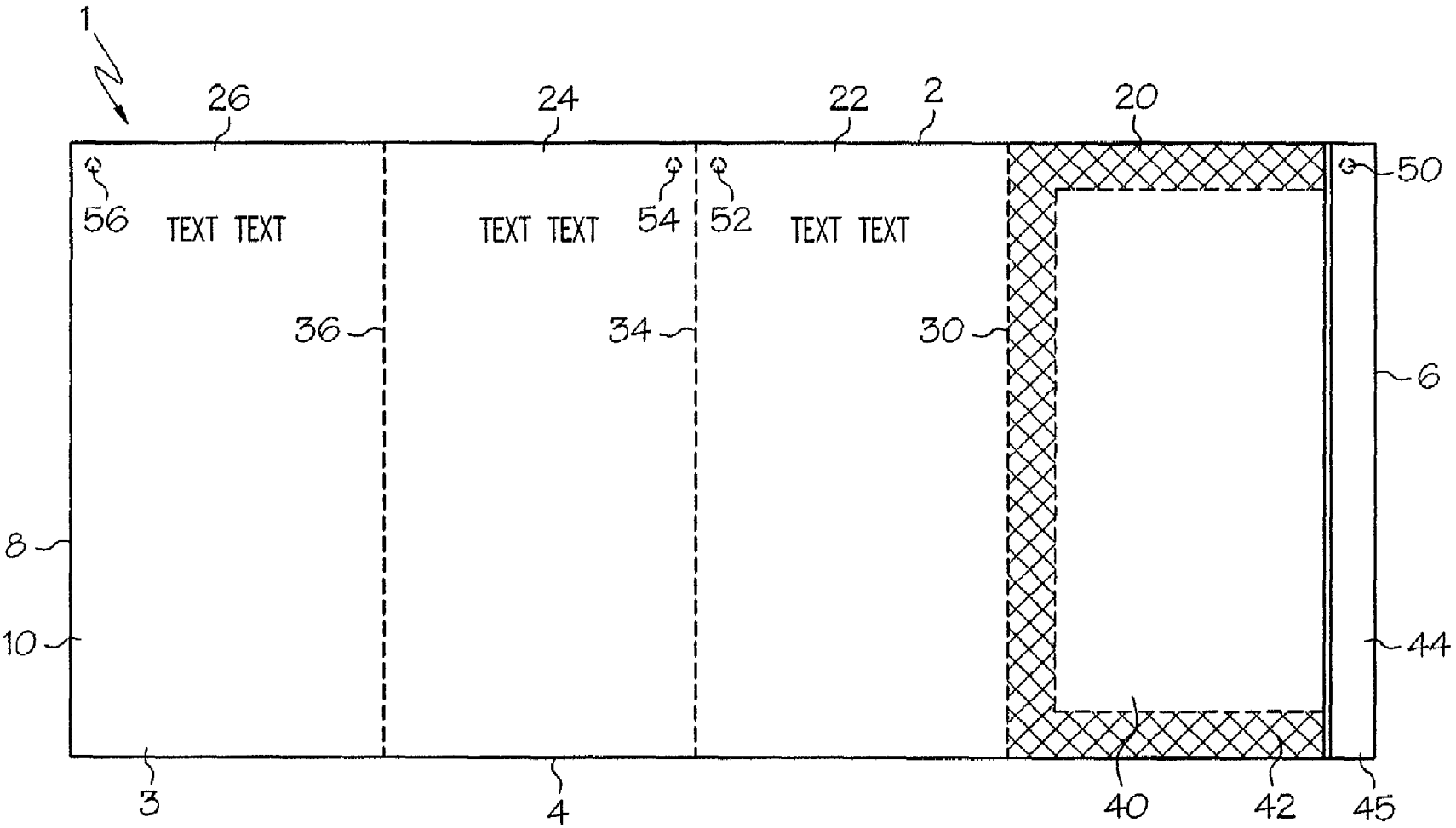
FIG. 1 is a front view of a first embodiment of a foldable information card.

The present invention is directed toward a foldable information card. The foldable information card has storage that allows loose papers to be kept with the information card.

In the following detailed description of the preferred embodiments, reference is made to the accompanying drawings that form a part hereof, and in which is shown by way of illustration, and not by way of limitation, specific preferred embodiments in which the invention may be practiced. In the drawings, like numerals describe substantially similar components throughout the several views.

Figure 2:
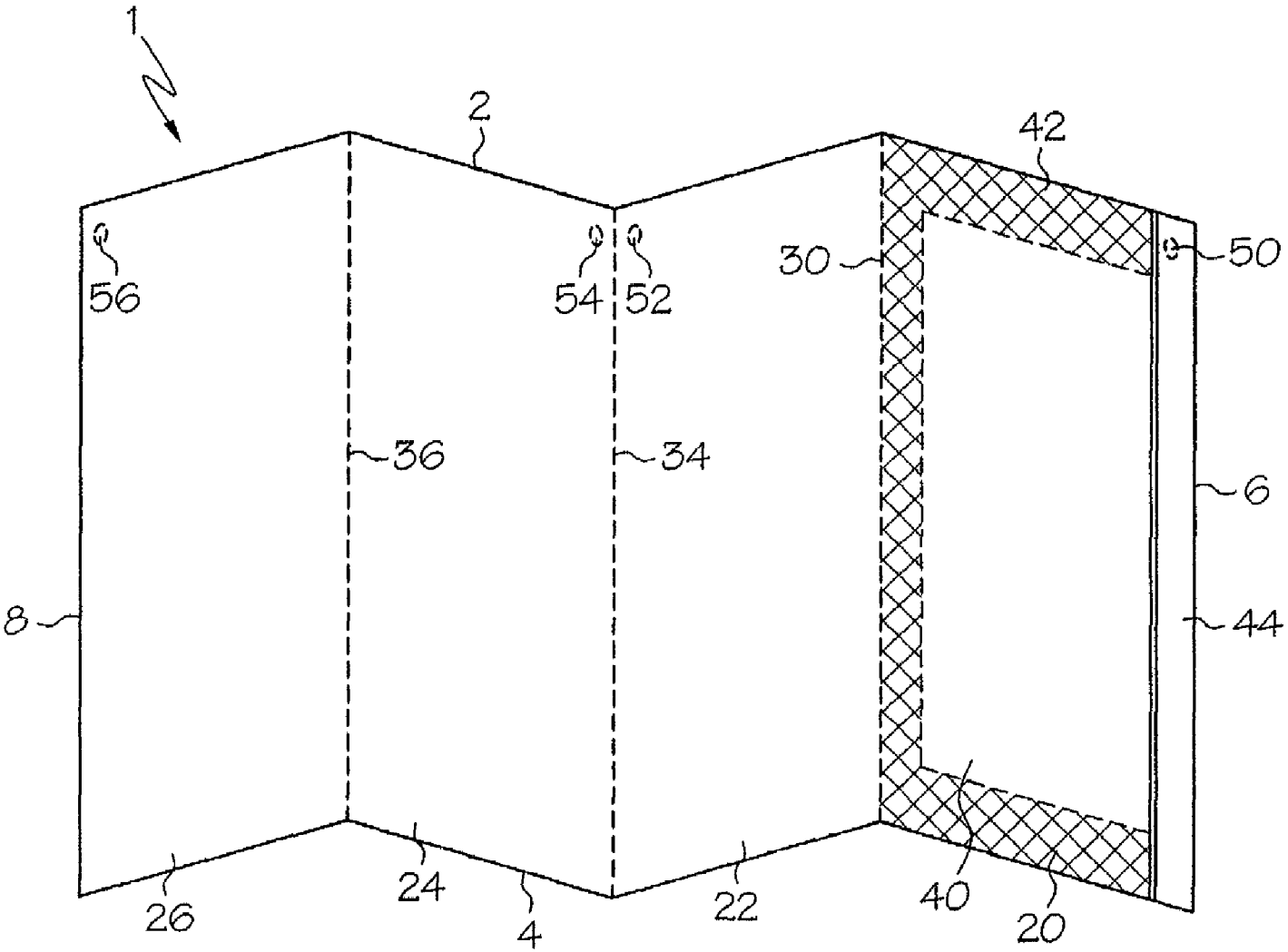
FIG. 2 is a plan view of a first embodiment of a foldable information card in a partially folded configuration.

Referring to FIGS. 1 and 2, a foldable information card 1 is illustrated. The foldable information card 1 has a foldable sheet 3, and the foldable sheet 3 has a top edge 2, a bottom edge 4, a first side edge 6, and a second side edge 8. Foldable sheet 3 may be made of any suitable foldable substrate. The foldable substrate will typically be a substrate upon which information may be printed using well known printing techniques such as flexographic, offset, letterpress, or gravure printing. Additionally, the foldable substrate may be a processed through a variable printer such as a laser or inkjet printer. A variable printer could add information to the foldable sheet, or a variable printer could entirely print information on the foldable substrate. Generally, the foldable sheet 3 will be made of paper or film. Typically, the foldable sheet 3 will be made of a heavy weight paper so that it is not easily torn or damaged by handling. For example, a 100 pound tag stock paper may be used for the foldable sheet 3. The foldable sheet 3 may be of any suitable dimensions. For example, the foldable sheet 3 may be an 8½" by 16" sheet.

The foldable sheet 3 has at least a first fold line 30. As used herein, the term "fold line" is defined to include perforation lines, score lines, or any other arrangement that facilitates folding the sheet along a predetermined axis. The first fold line 30 is generally parallel to the first and second side edges 6, 8 of the foldable sheet 3. The first fold line 30 is illustrated as going from the top edge 2 to the bottom edge 4 of the foldable sheet. However, it will be understood by those skilled in the art that fold lines may be provided that do not traverse the entire distance of the intended fold. The foldable sheet 3 has a first panel 20, and the first panel 20 is defined by the top edge 2, the bottom edge 4, and the first side edge 6 of the foldable sheet 3 and by the first fold line 30. Therefore, the edges of the first panel 20 are defined by the top edge 2, the bottom edge 4, and the first side edge 6 of the foldable sheet 3 and by the first fold line 30.

A pocket panel 40 partially overlies the first panel 20. The pocket panel 40 is generally made of paper or film, and the pocket panel 40 will typically be made of a lighter weight material than the foldable sheet 3. For example, a 24 pound bond paper may be used to form pocket panel 40. The pocket panel 40 is secured to the first panel by any suitable means to form a pocket between the pocket panel 40 and the first panel 20. For example, the pocket panel 40 may be secured using any conventional adhesive, such as a pressure sensitive or hot melt adhesive. The pocket panel 40 is generally secured to the first panel 20 such that an area along an edge of the first panel is exposed. Typically, the pocket panel 40 is secured to the first panel 20 such that an area 44 proximate to the first side edge 6 of the foldable sheet is exposed. Generally, the pocket panel 40 will be secured along three sides by a permanent adhesive 42, and an opening of the pocket is left along a fourth side of the pocket panel 40.

Typically, the opening of the pocket is proximate to the first side edge 6 of the foldable sheet 3.

The first panel 20 generally has a repositionable adhesive positioned on the first panel 20 proximate to the pocket panel 40 in the area exposed by the pocket panel 40. Typically, the repositionable adhesive will be positioned in an area 44 proximate the first side edge 6 of the foldable sheet. The repositionable adhesive allows the foldable sheet 3 to be folded about at least the first fold line 30 and secured in a folded configuration. As used herein, the term "folded configuration" is defined to mean folded along at least one fold line. When the repositionable adhesive is used to secure the foldable sheet in a folded configuration, documents placed in the pocket formed by the pocket panel 40 and the first panel 20 are prevented from falling out of the pocket. The foldable sheet 3 may be secured in a folded position about at least the first fold line 30 and subsequently unfolded to add or remove documents from the pocket or to read information printed on the foldable sheet 3. The repositionable adhesive may have a removable strip 45 positioned over the repositionable adhesive to prevent adhesion until it is removed by a user.

The foldable sheet 3 illustrated in FIGS. 1 and 2 has a second panel 22, a third panel 24, and a fourth panel 26. However, it will be understood that foldable sheet 3 may have a greater or lesser number of panels and that foldable sheet 3 will generally have at least two panels. In the embodiment illustrated in FIGS. 1 and 2, the second panel 22 is generally defined by the top edge 2 and the bottom edge 4 of the foldable sheet 3, the first fold line 30, and a second fold line 34. The second fold line 34 is generally parallel to the first fold line 30. The third panel 24 is defined by the top edge 2 and the bottom edge 4 of the foldable sheet 3, the second fold line 34, and a third fold line 36. The third fold line 36 is generally parallel to the second fold line 34. The fourth panel 26 is defined by the top edge 2, the bottom edge 4, and the second side edge 8 of the foldable sheet 3 and the third fold line 36.

It will be apparent to those having skill in the art that the pocket panel 40 may alternatively be secured to the second panel 22, the third panel 24, or the fourth panel 26 to form a pocket between the pocket panel and the respective second, third, or fourth panels 22, 24, 26. It will also be apparent that if the pocket panel is secured to the second, third, or fourth panels 22, 24, 26, the repositionable adhesive may be positioned on any suitable panel. For example, the adhesive may be positioned in area 44 or the adhesive may be positioned proximate to the pocket panel 40 on the respective second, third, or fourth panels 22, 24, 26.

It will be understood that the panels 20, 22, 24, 26 of the foldable sheet 3 may be of any suitable dimension. Generally, the first panel 20 will have dimensions substantially equal to dimensions of the second panel 22, and the third panel 24 and fourth panel 26 will have dimensions substantially equal to the dimensions of the second panel 22. Typically, the panels 20, 22, 24, 26 will be generally rectangular.

Figure 3:
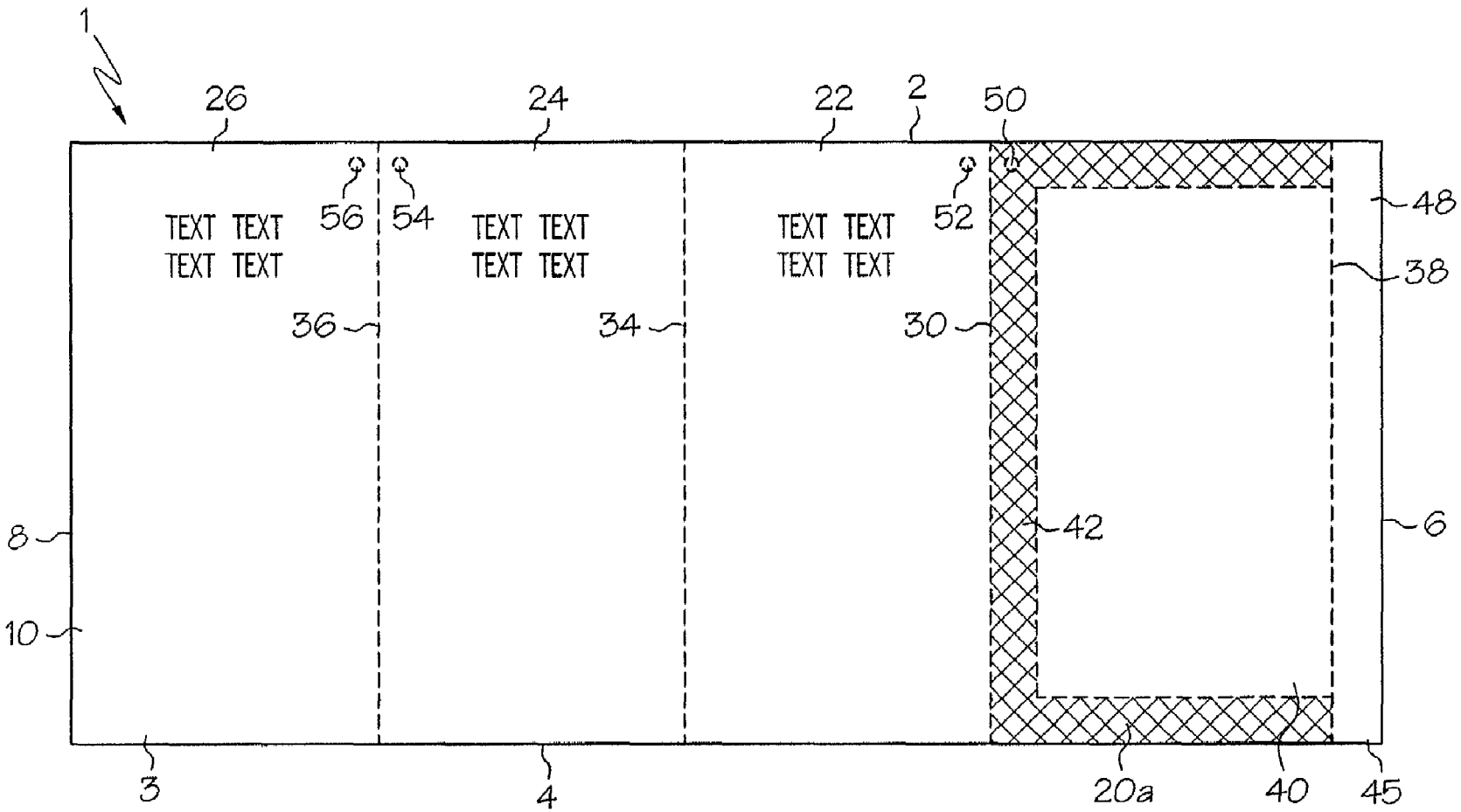
FIG. 3 is a front view of a second embodiment of a foldable information card.

Referring to FIG. 3, an alternative embodiment of a foldable information card 1 is illustrated. Foldable information card 1 has a foldable sheet 3 having a top edge 2, a bottom edge 4, a first side edge 6, and a second side edge 8. Foldable information card 3 has a first fold line 30 and a flap fold line 38. The first fold line 30 and the flap fold 38 are parallel to the first and second side edges 6, 8 of the foldable sheet 3.

A first panel 20*a* is defined by the top edge 2 and the bottom edge 4 of the foldable sheet, the first fold line 30, and the flap fold line 38. A flap 48 is defined by the top edge 2, the bottom edge 4, and the first side edge 6 of the foldable sheet 3 and by the flap fold line 38. A pocket panel 40 overlies the first panel 20 and is secured to the first panel 20 to form a pocket between the pocket panel 40 and the first panel 20. The pocket panel 40 generally has dimensions substantially equal to dimensions of the first panel 20, and the pocket panel 40 is generally secured along three sides to form a pocket opening proximate to the flap fold line 38. The pocket panel 40 is secured using the means discussed herein with regards to the embodiment illustrated in FIGS. 1 and 2.

The flap 48 generally has a repositionable adhesive thereon. The adhesive is positioned on the flap 48 such that the foldable sheet 3 may be folded about at least the flap fold line and secured in a folded position. The flap 48 may be used to prevent documents stored in the pocket formed by the pocket panel 40 and the first panel 20 from falling out of the pocket. The flap 48 may have a removable strip 45 positioned over the repositionable adhesive on the flap 48 to prevent adhesion until a user removes it.

The foldable sheet 3 illustrated in FIG. 3 has second, third, and fourth panels 22, 24, 26, but it will be understood that the foldable sheet 3 may have more panels or fewer panels. Generally, the foldable sheet will have at least two panels. The second panel 22 is defined by the top edge 2 and the bottom edge 4 of the foldable sheet 3, the first fold line 30, and a second fold line 34. The second fold line 34 is generally parallel to the first fold line 30. The third panel 24 is defined by the top edge 2 and the bottom edge 4 of the foldable sheet 3, the second fold line 34, and a third fold line 36. The third fold line 36 is generally parallel to the second fold line 34. The fourth panel 26 is defined by the top edge 2, the bottom edge 4, and the second side edge 8 of the foldable sheet 3 and the third fold line 36.

It will be apparent to those having skill in the art that the pocket panel 40 may alternatively be secured to the second panel 22, the third panel 24, or the fourth panel 26 to form a pocket between the pocket panel and the respective second, third, or fourth panels 22, 24, 26.

It will also be apparent that if the pocket panel is secured to the second, third, or fourth panels 22, 24, 26, the repositionable adhesive on the flap 48 may be used to secure the foldable sheet 3 in a folded configuration.

The first, second, third, and fourth panels may be of any suitable dimension. Generally, the first panel 20 may have dimensions that are greater than dimensions of the second panel 22, the third panel 24, and the fourth panel 26. The dimensions of the second, third, and fourth panels 22, 24, 26 may be substantially equal. The first panel 20 may have greater dimensions than the other panels to facilitate using the flap 48 to secure the foldable sheet 3 in a folded configuration when the foldable sheet 3 is folded along the first, second, and third fold lines 30, 34, 36.

Referring to FIGS. 1–3, the foldable information card 3 may have shaped perforations. The first panel 20 generally has a first shaped perforation 50, and the second panel 22 generally has a second shaped perforation 52. The first perforation 50 and the second perforation 52 are generally arranged such that the first and second shaped perforations 50, 52 align when the foldable sheet 3 is folded along the first fold line 30. Similarly, the third panel 24 has a third shaped perforation 54, and the fourth panel 26 has a fourth shaped perforation 56. The third shaped perforation 54 is arranged such that the second shaped perforation 52 aligns with the third shaped perforation 54 when the foldable sheet 3 is folded along the second fold line 34. The fourth perforation 56 is arranged such that the third and fourth shaped perforations 54, 56 align when the foldable sheet 3 is folded along the third fold line 36.

The shaped perforations may be arranged in a number of different positions. For example, referring to FIGS. 1 and 2, the first shaped perforation 50 is located proximate to the top edge 2 and to the first side edge 6 of the foldable sheet. The second shaped perforation 52 and the third shaped perforation 54 are located proximate to the second fold line 34 and the top edge 2 of the foldable sheet 3 on their respective panels. The fourth shaped perforation 56 is located proximate to the top edge 2 and the second side edge 8 of the foldable sheet 3.

Referring to FIG. 3, the first and second shaped perforations 50, 52 are located proximate to the first fold line 30 and the top edge 2 of the foldable sheet 3 on their respective panels. The third and fourth shaped perforations 54, 56 are located proximate to the third fold line 36 and the top edge 2 of the foldable sheet 3 on their respective panels. It will be understood that the positions of the shaped perforations are not limited to the particular embodiments on which they are illustrated. Further, it will be understood that the shaped perforations may define flaps which do not completely separate from the foldable sheet. Additionally, it will be understood that the positions of the respective shaped perforations may be changed in any desired manner as long as the perforations align properly.

When the foldable sheet 3 is folded along the first, second, and third fold lines 30, 34, 36, the shaped perforations may be removed and fastener such as a plastic or elastic tie may be inserted through the resulting holes. The foldable sheet 3 may then be attached to an item to ensure that the information card is provided when a consumer receives the item. It will be understood that shaped perforations 50, 52, 54, and 56 may be of any shape that enables a fastener to be passed through the shaped perforations. For example, the shaped perforations may be in the shape of a circle, square, rectangle, or oval, or an incomplete circle, square, rectangle, or oval.

Figure 4B:
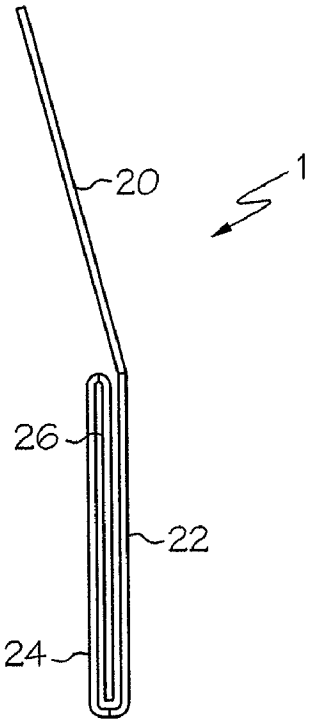
FIGS. 4*a*–4*b* are schematic illustrations of folded configurations for the foldable information card.
Figure 4A:
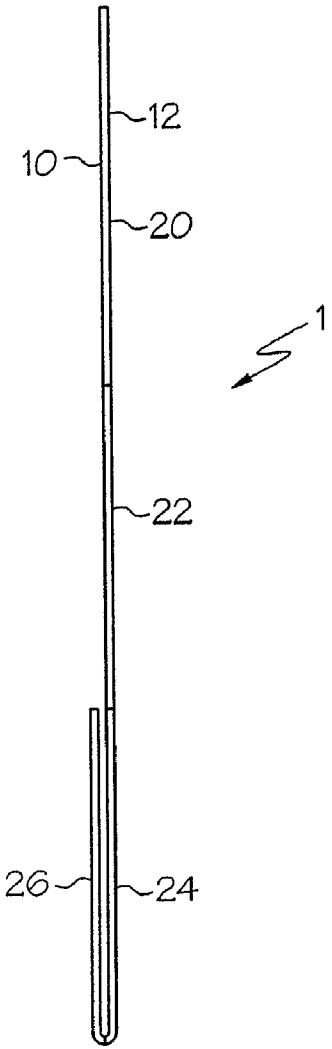
Figure 5B:
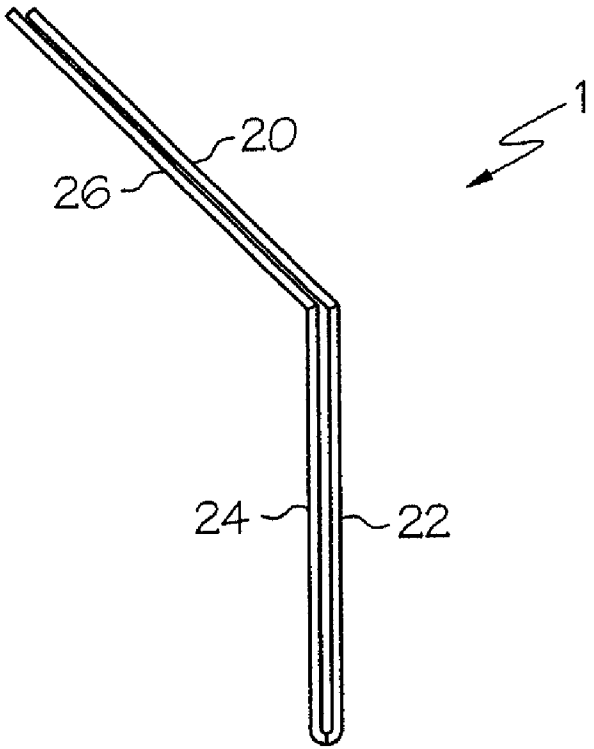
FIGS. 5*a*–5*b* are schematic illustrations of alternative folded configurations for the foldable information card.
Figure 5A:
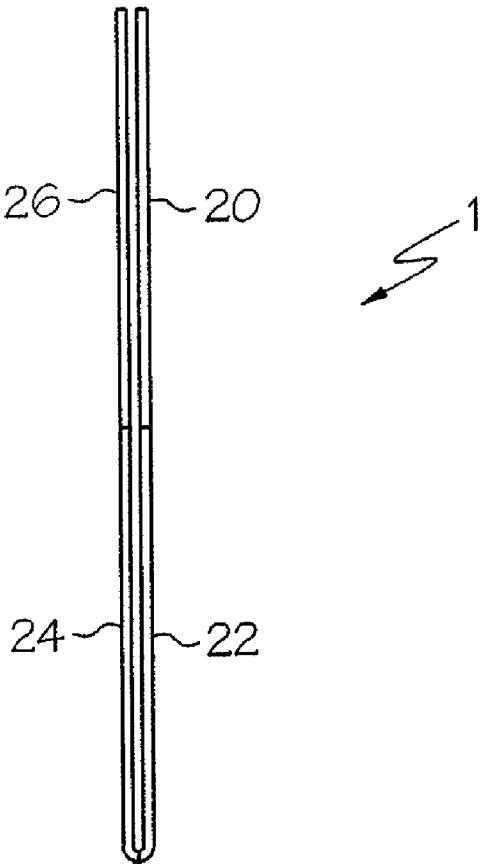

Referring to FIGS. 2, 4*a*, 4*b*, 5*a*, and 5*b*, the foldable card 1 may be folded about the first, second, and third fold lines 30, 34, and 36 in a number of configurations. As shown in FIG. 2, the foldable card 1 may be folded in a z-fold configuration. Alternatively, the foldable card 1 may be folded in a c-fold configuration as illustrated in FIGS. 4*a* and 4*b*. The foldable card 1 may also be folded in a double v-fold configuration as shown in FIGS. 5*a* and 5*b*. The shaped perforations 50, 52, 54, and 56 align regardless how the foldable card 1 is folded. Additionally, the foldable card 1 may be left partially folded. For example, the card may be folded as illustrated in FIGS. 4*a* and 5*a*. The adhesive in area 44 of the first panel 20 may be adhered to any of the panels 22, 24, and 26 that it contacts. For example in the z-fold configuration of FIG. 2, the adhesive will be adhered to second panel 22. Alternatively as shown in FIG. 4*b*, it may be adhered to third panel 26. The adhesive may also be adhered to the fourth panel 26 as shown in FIG. 5*a*.

Although the folded configurations are illustrated without the flap 48 of the embodiment illustrated in FIG. 3, it will be understood that the embodiment in FIG. 3 may be folded in a similar manner with the flap 48 folded about the flap fold line 38 in any desired fashion. For example, the flap 48 may be folded over all of the panels to secure the card in the folded configurations illustrated in FIGS. 2, 4*b*, and 5*b*. Alternatively, when the card in the folded configuration illustrated in FIG. 5*a*, the flap may be folded over the fourth panel 26 to secure the card in a partially folded configuration. Flap 48 may also be folded about flap fold line 38 and secured to the first panel 20*a* to prevent documents from falling out of the pocket formed by the pocket panel 40 and the first panel 20*a*.

As can be seen in FIGS. 1, 3, and 4*a*, the foldable sheet 3 has a front face 10 and a rear face 12. The front face 10 and the rear face 12 may contain textual information printed on the front and rear faces 10, 12. Generally, this information will be warranty information. However, the information may be other information such as product information. The warranty information may be printed in more than one language. In one embodiment, the warranty information may be printed in three languages. For example, the second panel 22 may have warranty information printed on the front face 10 and the rear face 12 in English. The third panel 24 may have warranty information printed on the front face 10 and the rear face 12 in French. The fourth panel 26 may have warranty information printed on the front and rear face 10, 12 in Spanish. Generally, the pocket panel 40 will not have information printed thereon. However, the rear face 12 of the first panel 20 may have information printed thereon.

It will be obvious to those skilled in the art that various changes may be made without departing from the scope of the invention, which is not to be considered limited to what is described in the specification.

What is claimed is:

1. A foldable information card, comprising:

a foldable sheet having a top edge, a bottom edge, and first and second side edges;

said foldable sheet having at least a first fold line parallel to said first and second side edges;

said foldable sheet having at least a first panel and a second panel, wherein said first panel is defined by said first side edge of said foldable sheet, said top edge of said foldable sheet, said bottom edge of said foldable sheet, and said first fold line, wherein said first panel has a first shaped perforation and said second panel has a second shaped perforation, and wherein said first and second shaped perforations are arranged such that said first and second shaped perforations align when said foldable sheet is folded along said first fold line;

a pocket panel partially overlying said first panel of said foldable sheet and secured to said first panel to form a pocket between said pocket panel and said first panel, and leaving an area along an edge of said first panel exposed;

a repositionable adhesive on said first panel positioned proximate to said pocket panel such that said foldable sheet may be folded along at least said first fold line and secured in a folded configuration using said repositionable adhesive; and said foldable sheet having a third panel and a fourth panel, wherein:

said second panel is defined by said top edge of said sheet, said bottom of said sheet, said first fold line, and a second fold line parallel to said first fold line;

said third panel is defined by said top edge of said sheet said bottom edge of said sheet, said second fold line, and a third fold line parallel to said second fold line;

said fourth panel is defined by said top edge of said sheet, said bottom edge of said sheet, said third fold line, and said second side edge of said sheet; and said foldable sheet may be folded along said first, second, and third fold lines and secured in a folded configuration using said repositionable adhesive.

2. The foldable information card of claim 1 wherein said pocket panel is secured to said first panel of said foldable sheet such that an opening of said pocket is proximate to said first side edge of said first panel.

3. The foldable information card of claim 1 wherein said pocket panel is secured to said first panel of said foldable sheet by a permanent adhesive.

4. The foldable information card of claim 1 wherein said foldable sheet has information printed thereon by a variable printer.

5. The foldable information card of claim 1 wherein said first panel has dimensions that are substantially equal to dimensions of said second panel, and wherein said third and fourth panels have dimensions that are substantially equal to said dimensions of said second panel.

6. The foldable information card of claim 1 wherein said first, second, third, and fourth panels are generally rectangular.

7. The foldable information card of claim 1 wherein said third panel has a third shaped perforation and said fourth panel has a fourth shaped perforation, and wherein:

said third shaped perforation is arranged such that said third shaped perforation aligns with said second shaped perforation when said foldable sheet is folded along said second fold line;

said fourth shaped perforation is arranged such that such that said fourth shaped perforation aligns with said third shaped perforation when said foldable sheet is folded along said third fold line.

8. The foldable information card of claim 7 wherein:

said first shaped perforation is located proximate to said first side edge and to said top edge of said foldable sheet;

said second shaped perforation is located proximate to said second fold line and to said top edge of said foldable sheet;

said third shaped perforation is located proximate to said second fold line and to said top edge of said foldable sheet; and said fourth perforation is located proximate to said top edge and to said second side edge of said foldable sheet.

9. The foldable information card of claim 7 wherein:

said first shaped perforation is located proximate to said first fold line and to said top edge of said foldable sheet;

said second shaped perforation is located proximate to said first fold line and to said top edge of said foldable sheet;

said third shaped perforation is located proximate to said third fold line and to said top edge of said foldable sheet; and said fourth shaped perforation is located proximate to said third fold line and to said top edge of said foldable sheet.

10. The foldable information card of claim 1 wherein said foldable sheet has a front face and a rear face, and wherein said foldable sheet has warranty information printed on at least one of said front or rear faces of said foldable sheet.

11. The foldable information card of claim 10 wherein said warranty information is printed in more than one language.

12. A foldable information card, comprising:

a foldable sheet having a top edge, a bottom edge, and first and second side edges;

said foldable sheet having at least a first fold line parallel to said first and second side edges;

said foldable sheet having a flap fold line parallel to said first and second side edges;

said foldable sheet having a flap, wherein said flap is defined by said first side edge of said foldable sheet, said top and bottom edges of said foldable sheet, and said flap fold line;

said foldable sheet having at least a first panel and a second panel, wherein said first panel is defined by said flap fold line, said top edge of said foldable sheet, said bottom edge of said foldable sheet, and said first fold line, wherein said first panel has a first shaped perforation and said second panel has a second shaped perforation, and wherein said first and second shaped perforations are arranged such that said first and second shaped perforations align when said foldable sheet is folded along said first fold line;

a pocket panel overlying said first panel of said foldable sheet and secured to said first panel to form a pocket between said pocket panel and said first panel;

a repositionable adhesive on said flap positioned such that said foldable sheet may be folded along at least said flap fold line and secured in a folded configuration using said repositionable adhesive; and said foldable sheet has a third panel and a fourth panel, wherein:

said second panel is defined by said ton edge of said sheet, said bottom of said sheet, said first fold line, and a second fold line parallel to said front fold line;

said third panel is defined by said top edge of said sheet, said bottom edge of said sheet, said second fold line, and a third fold line parallel to said second fold line;

said fourth panel is defined by said top edge of said sheet, said bottom edge of said sheet, said third fold line, and said second side edge of said sheet; and said foldable sheet may be folded along said first, second, and third fold lines and secured in a folded configuration using said repositionable adhesive on said flap.

13. The foldable information card of claim 12 wherein said pocket panel has dimensions about equal to dimensions of said first panel.

14. The foldable information card of claim 12 wherein said pocket panel is secured to said first panel such that an opening of said pocket is proximate to said first side edge of said first panel.

15. The foldable information card of claim 12 wherein said pocket panel is secured to said first panel of said foldable sheet by a permanent adhesive.

16. The foldable information card of claim 12 wherein said foldable sheet has information printed thereon by a variable printer.

17. The foldable information card of claim 12 wherein said flap fold line and said first fold line are positioned such that said first panel has dimensions larger than said second panel.

18. The foldable information card of claim 17 wherein said second panel has dimensions that are substantially equal to dimensions of said third panel, and wherein said fourth panel has dimensions that are substantially equal to dimensions of said third panel.

19. The foldable information card of claim 12 wherein said third panel has a third shaped perforation and said fourth panel has a fourth shaped perforation, and wherein:

said third shaped perforation is arranged such that said third shaped perforation aligns with said second shaped perforation when said foldable sheet is folded along said second fold line;

said fourth shaped perforation is arranged such that said fourth shaped perforation aligns with said third shaped perforation when said foldable sheet is folded along said third fold line.

20. The foldable information card of claim 19 wherein:

said first shaped perforation is located proximate to said first side edge and to said top edge of said foldable sheet;

said second shaped perforation is located proximate to said second fold line and to said top edge of said foldable sheet;

said third shaped perforation is located proximate to said second fold line and to said top edge of said foldable sheet; and said fourth perforation is located proximate to said top edge and to said second side edge of said foldable sheet.

21. The foldable information card of claim 19 wherein:

said first shaped perforation is located proximate to said first fold line and to said top edge of said foldable sheet;

said second shaped perforation is located proximate to said first fold line and to said top edge of said foldable sheet;

said third shaped perforation is located proximate to said third fold line and to said top edge of said foldable sheet; and said fourth shaped perforation is located proximate to said third fold line and to said top edge of said foldable sheet.

22. The foldable information card of claim 12 wherein said foldable sheet has a front face and a rear face, and wherein said foldable sheet has warranty information printed on at least one of said front face or rear faces of said foldable sheet.

23. The foldable information card of claim 22 wherein said warranty information is printed in more than one language.

* * * * *

UNITED STATES PATENT AND TRADEMARK OFFICE

CERTIFICATE OF CORRECTION

PATENT NO. : 7,200,960 B1
APPLICATION NO. : 10/164211
DATED : April 10, 2007
INVENTOR(S) : Waggoner et al.

It is certified that error appears in the above-identified patent and that said Letters Patent is hereby corrected as shown below:

Col. 8, line 24, “ton” should read --top--

Signed and Sealed this

Sixteenth Day of October, 2007

JON W. DUDAS
*Director of the United States Patent and Trademark Office*